US010425714B2

(12) United States Patent
Lawand et al.

(10) Patent No.: US 10,425,714 B2
(45) Date of Patent: Sep. 24, 2019

(54) EAR BUD OR DOME

(71) Applicant: Sonion Nederland B.V., Hoofddorp (NL)

(72) Inventors: Nishant Lawand, Hoofddorp (NL); Peter Rietman, Hoofddorp (NL); Theodorus Geradus Maria Brouwer, Hoofddorp (NL); René Maas, Hoofddorp (NL); Robert Bakuwel, Hoofddorp (NL); Ricardo Timothy Jonathan Muijtjens, Hoofddorp (NL); Sally van der Most, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 15/788,475

(22) Filed: Oct. 19, 2017

(65) Prior Publication Data

US 2018/0109862 A1 Apr. 19, 2018

(30) Foreign Application Priority Data

Oct. 19, 2016 (EP) ..... 16194625

(51) Int. Cl.

| | |
|---|---|
| ***H04R 25/00*** | (2006.01) |
| ***H04R 1/10*** | (2006.01) |
| ***H04R 1/12*** | (2006.01) |

(52) U.S. Cl.

CPC ..... *H04R 1/1016* (2013.01); *H04R 1/12* (2013.01); *H04R 25/656* (2013.01); *H04R 25/654* (2013.01)

(58) Field of Classification Search

CPC combination set(s) only.
See application file for complete search history.

(56) References Cited

U.S. PATENT DOCUMENTS

| | | | |
|---|---|---|---|
| 6,513,621 | B1 | 2/2003 | Deslauriers |
| 6,788,796 | B1 | 9/2004 | Miles |
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |

(Continued)

FOREIGN PATENT DOCUMENTS

| | | |
|---|---|---|
| DE | 102012215160 | 8/2013 |
| EP | 1781068 | 5/2007 |

(Continued)

OTHER PUBLICATIONS

European Patent Office, Partial European Search Report for Application No. EP 16194625.6, dated Feb. 10, 2017 (7 pages).

(Continued)

*Primary Examiner* — Amir H Etesam
(74) *Attorney, Agent, or Firm* — Nixon Peabody LLP

(57) ABSTRACT

An ear bud or cone having multiple protruding, convex and soft elements which are configured to be deformed during insertion, extraction and operation in the ear canal of a person. The soft elements are cushion shaped and thus able to adapt to any shape of the ear canal without exerting excessive force to portions of the ear canal.

16 Claims, 6 Drawing Sheets

(56) References Cited

U.S. PATENT DOCUMENTS 6,930,259 B1 8/2005 Jorgensen
6,943,308 B2 9/2005 Ravnkilde
6,974,921 B2 12/2005 Jorgensen
7,008,271 B2 3/2006 Jorgensen
7,012,200 B2 3/2006 Moller
7,027,608 B2 * 4/2006 Fretz ..... H04R 25/65 381/322
7,062,058 B2 6/2006 Steeman
7,062,063 B2 6/2006 Hansen
7,072,482 B2 7/2006 Van Doom
7,088,839 B2 8/2006 Geschiere
7,110,560 B2 9/2006 Stenberg
7,136,496 B2 11/2006 van Halteren
7,142,682 B2 11/2006 Mullenbom
7,181,035 B2 2/2007 van Halteren
7,190,803 B2 3/2007 van Halteren
7,206,428 B2 4/2007 Geschiere
7,221,767 B2 5/2007 Mullenbom
7,221,769 B1 5/2007 Jorgensen
7,227,968 B2 6/2007 van Halteren
7,239,714 B2 7/2007 de Blok
7,245,734 B2 7/2007 Niederdraenk
7,254,248 B2 8/2007 Johannsen
7,286,680 B2 10/2007 Steeman
7,292,700 B1 11/2007 Engbert
7,292,876 B2 11/2007 Bosh
7,336,794 B2 2/2008 Furst
7,376,240 B2 5/2008 Hansen
7,403,630 B2 7/2008 Jorgensen
7,415,121 B2 8/2008 Mögelin
7,425,196 B2 9/2008 Jorgensen
7,460,681 B2 12/2008 Geschiere
7,466,835 B2 12/2008 Stenberg
7,492,919 B2 2/2009 Engbert
7,548,626 B2 6/2009 Stenberg
7,602,933 B2 * 10/2009 Cartwright ..... A61F 11/008 128/867
7,657,048 B2 2/2010 van Halteren
7,684,575 B2 3/2010 van Halteren
7,706,561 B2 4/2010 Wilmink
7,715,583 B2 5/2010 Van Halteren
7,728,237 B2 6/2010 Pedersen
7,809,151 B2 10/2010 Van Halteren
7,822,218 B2 10/2010 Van Halteren
7,899,203 B2 3/2011 Van Halteren
7,912,240 B2 3/2011 Madaffari
7,946,890 B1 5/2011 Bondo
7,953,241 B2 5/2011 Jorgensen
7,961,899 B2 6/2011 van Halteren
7,970,161 B2 6/2011 van Halteren
8,098,854 B2 1/2012 van Halteren
8,101,876 B2 1/2012 Andreasen
8,103,039 B2 1/2012 van Halteren
8,160,290 B2 4/2012 Jorgensen
8,170,249 B2 5/2012 Halteren
8,189,804 B2 5/2012 Hruza
8,189,820 B2 5/2012 Wang
8,223,996 B2 7/2012 Beekman
8,233,652 B2 7/2012 Jorgensen
8,259,963 B2 9/2012 Stenberg
8,259,976 B2 9/2012 van Halteren
8,259,977 B2 9/2012 Jorgensen
8,280,082 B2 10/2012 van Halteren
8,284,966 B2 10/2012 Wilk
8,313,336 B2 11/2012 Bondo
8,315,422 B2 11/2012 van Halteren
8,331,595 B2 12/2012 van Halteren
8,369,552 B2 2/2013 Engbert
8,369,554 B2 2/2013 Oberlander
8,379,899 B2 2/2013 van Halteren
8,477,978 B2 7/2013 Caldarola
8,509,468 B2 8/2013 van Halteren
8,526,651 B2 9/2013 Lafort
8,526,652 B2 9/2013 Ambrose
8,792,663 B2 7/2014 Cano
9,313,568 B2 4/2016 Basseas
2007/0009106 A1 1/2007 Tilson
2009/0123010 A1 * 5/2009 Cano ..... H04R 1/1016 381/318
2011/0182453 A1 7/2011 van Hal
2011/0189880 A1 8/2011 Bondo
2011/0299708 A1 12/2011 Bondo
2011/0299712 A1 12/2011 Bondo
2011/0311069 A1 12/2011 Ambrose
2012/0014548 A1 1/2012 van Halteren
2012/0027245 A1 2/2012 van Halteren
2012/0140966 A1 6/2012 Mocking
2012/0155683 A1 6/2012 van Halteren
2012/0155694 A1 6/2012 Reeuwijk
2012/0255805 A1 10/2012 van Halteren
2013/0028451 A1 1/2013 de Roo
2013/0136284 A1 5/2013 van Hal
2013/0142370 A1 6/2013 Engbert
2013/0163799 A1 6/2013 van Halteren
2013/0195295 A1 8/2013 van Halteren
2016/0029115 A1 * 1/2016 Shen ..... H04R 1/1083 381/372
2017/0118548 A1 * 4/2017 Liu ..... H04R 1/1016

FOREIGN PATENT DOCUMENTS

EP 2192789 6/2010
WO WO 99/04601 1/1999
WO WO 99/39548 8/1999
WO WO 00/01199 A1 1/2000

OTHER PUBLICATIONS

European Patent Office, Extended European Search Report for Application No. EP 161946256, dated May 12, 2017 (10 pages).
Extended European Search Report in European Patent Application No. 17197395.1, dated Feb. 19, 2018 (4 pages).

* cited by examiner

EAR BUD OR DOME

CROSS-REFERENCE TO RELATED APPLICATIONS

This application claims the benefit of European Patent Application Serial No. 16194625.6, filed Oct. 19, 2016, which is incorporated herein by reference in its entirety.

FIELD OF THE INVENTION

The present invention relates to an ear bud or dome having a new shape which facilitates introduction thereof into an ear canal and removal thereof from the ear canal without causing excessive pain. In addition, the ear bud or dome is able to maintain its position in the ear canal during use without exerting excessive force to the ear canal.

BACKGROUND OF THE INVENTION

Ear buds or domes may be seen in e.g. EP2192789, U.S. Pat. Nos. 6,513,621, 7,027,608, 8,369,554, 8,477,978, 8,792,663, US20070009106 and U.S. Pat. No. 9,313,568.

In a first aspect, the invention relates to an ear bud or dome according to claim 1.

In this context, an ear bud or dome is an element configured and dimensioned to be provided inside a person's ear canal. Often, the ear bud or dome is configured to receive therein or have attached thereto a receiver or a sound tube for providing sound in the ear bud/dome, where that sound is then output from an opening of the bud/dome. The function of the ear bud is to maintain the sound opening in a desired position in relation to the person's ear canal or e.g. ear drum.

However, in order to reach this position, the ear bud is to be transported (forced) into and through the ear canal, which has varying dimensions and which is not perfectly circular in cross section or not entirely oval-shaped but which may have protrusions etc. which must be negotiated on the way to the desired position in the ear canal.

SUMMARY OF INVENTION

In the present context, the rest position is a position where the ear bud is not stressed or deformed, such as when lying on a table affected only by gravity.

Often, ear buds have an outer diameter of 6-12 mm and/or a total length along the longitudinal axis of 4-15 mm, such as 6-12 mm.

The central portion may have any dimensions. The channel often has a diameter of 0.5-1.5 mm, and the central portion defines the channel. The central portion may be formed merely of a wall encircling the channel, such as a wall with a thickness of 0.5-1 mm.

The central portion may be made of a material with a hardness higher than the 30 Shore A, such as 40, 50 or 60 Shore A. Preferably, the central portion is made of a material having a hardness in the interval of 40-60 Shore A.

The central portion may be made of LSR (Liquid Silicone Rubber) or TPE (Thermoplastic Elastomer), for example.

Often the channel of the central portion has therein engagement elements, such as ridges and/or one or more threads for receiving or attaching to elements, such as in a detachable manner. Such elements may be a sound generator, a sound tube, one or more wax filters or the like. Usually, the channel is straight, even though this is not a requirement.

The central portion may have an outer portion at a sound output of the channel which is replaceable, such as to provide a removable wax filter or a sound outputting spout with desired dimensions.

The central portion has two ends, usually at opposite portions of the central portion along the longitudinal axis. Often, the channel has an opening at each end.

The longitudinal axis may be a symmetry axis of the central portion or an axis extending in the channel, such as in or a long a centre of the channel.

A convex element is an element extending away from the central portion. The present convex elements are soft, or at least the outermost portions thereof are soft. These outermost portions will be engaging the ear canal when the ear bud is forced into and through the ear canal. When these elements are soft, the force exerted to the ear canal walls will be distributed over a larger area, causing less pain. Even when the ear canal has e.g. a protrusion or a bend which compresses a convex element, the convex element is able to take up the deformation caused and distribute the force thus exerted to the convex element over also other portions of the ear canal than the protrusion.

Preferably, the convex elements for a continuous surface which usually is convex seen from all angles toward the convex element from along the longitudinal axis and from the first end toward the second end and to an angle perpendicular to the longitudinal axis.

A maximum distance is defined as a largest distance, perpendicularly to the longitudinal axis, from the longitudinal axis to any portion of a convex element. This distance may also be seen as a radius of a (smallest) circle, in a plane perpendicular to the longitudinal axis onto which the convex elements are projected, which circumscribes the convex elements.

In order to ensure that the convex elements are sufficiently resilient and are able to take up the deformation required by the ear canal while causing a comfortable pressure level on sides of ear canal, it is desired that all portions, the first or outer portions, of the convex elements positioned at least 30% of the maximum distance from the longitudinal axis have particular properties.

One such property is that they take up a sufficient portion of the circumference of the ear bud to present a sufficient area for contacting the ear canal. More precisely, it is desired that the outer portions of the convex elements take up a total angle, seen from the longitudinal axis and when projected on to a plane perpendicular to the longitudinal axis, of at least 80 degrees. This angle actually preferably is higher, such as at least 90, 100, 120, 140, 160, 180, 200, 220, 240 or 260 degrees.

Another property is that these outer portions are soft, such as when they have a hardness of 40 Shore A or less, such as 30 Shore A or less, 25 Shore A or less, such as 20 Shore A or less. Thus, a soft material is provided which in itself will allow deformation of the outer portions when required. Preferably, the outer portions, such as the convex elements in general, are made of an elastically deformable material.

Naturally, the convex elements or the outer portions may be made of a solid material. Alternatively, they may be formed by an outer shell of one material and be either hollow or filled with another material, preferably a foam or a soft material, such as a silicone material or another material with a hardness of 0-10, such as 4-8 shore A. The shell may be hollow and filled with gas or air, such as at a pressure of up to 5 kPa, such as in the interval of 2-4 kPa.

Even though a force exerted to the ear canal wall will depend on the ear canal cross section and the ear bud dimensions, it is desired that the convex elements exert a force below 0.005 N/m2, such as in the interval of 0.002-0.004N/m2, both during introduction/removal and during operation when in the desired position, preferably outside of the bony area in the ear canal.

Any number of convex elements may be used, such as 2, 3, 4, 5, 6, 7, 8, 9, 10 or more.

Also, it may be desired that the first or outer portions, are the portions of the convex elements positioned at least 40%, such as at least 50%, such as at least 60%, such as at least 70%, such as at least 80% of the maximum distance from the longitudinal axis. The percentage may be determined from a softness/hardness of the remaining portions of the ear bud (as they may also deform) and the overall dimensions of the ear bud and the ear canal.

The convex elements may be identical in size, or different sizes or dimensions may be used. The convex elements may be provided around the longitudinal axis and/or along the longitudinal axis.

A space, such as a concave space, is provided between neighbouring convex elements in the cross section. In this manner, a deformation of a convex element may be a compression in a direction toward the longitudinal axis but an expansion in a direction toward a neighbouring convex element and thereby into the space between these elements. Thus, this deformation is facilitated by the spaces in order to not increase the force exerted to the ear canal excessively.

In one embodiment, the convex elements are dimensioned to not touch each other when they are inserted inside the ear canal thus ensuring an open condition at all stages of usage. In that situation, sound and air (pressure compensation) may pass the ear bud also when inserted. Alternatively, as is described below, one or more holes may be provided in the convex elements for this purpose. In another embodiment, the deformed convex elements may touch when inserted.

Naturally, this deformation or expansion may be along the longitudinal direction or in a direction in a plane perpendicular thereto—or a combination thereof. Often a deformation of the central portion is not possible or desirable, whereby the shape of the deforming surface/protrusion/element and the central portion define where an expansion cannot be directed, whereas the expansion may be directed into other directions, such as directions of available space around the convex elements.

In one embodiment, all portions of the convex elements positioned:

- at longitudinal positions within a predetermined distance from the first end and
- at least 90%, such as at least 80%, such as at least 70% of the maximum distance from the longitudinal axis:

have a curvature radius of at least 10%, such as at least 20%, such as at least 30%, such as at least 50%, of the maximum distance.

Preferably, the predetermined distance is selected so that all portions of the convex elements at the end of the central portion with sound output have this minimum curvature, so that all portions of the ear bud contacting the ear canal during introduction into the ear canal have this minimum curvature in order to not damage the ear canal.

The predetermined distance may be chosen so that portions of the convex elements at an opposite end (not at the sound output) may be included, so as to also have rounded elements contact the ear canal during removal from the ear canal.

The distance may be 10%, 20%, 30%, 40%, 50%, 60%, 70%, 80%, 90% or 100% of a total length of the central portion.

Alternatively, the convex elements may be allowed to be concave/hollow/open when viewed along the longitudinal axis from a direction of the opening for receiving the receiver/tube toward the sound output opening.

In one embodiment, the convex elements, at longitudinal positions along the longitudinal axis of the first/outer portions, in a cross section in a plane perpendicular to the longitudinal axis, have a contour which:

- when viewed from a position inside the cross section, is concave in all directions or
- if the convex element engages the central portion in the cross section, when viewed from a position inside the cross section, the contour is concave in all directions not directed toward the central portion.

Thus, at the longitudinal positions where the outer portions of the convex elements exist, the convex elements are preferably cushion shaped or balloon shaped. In such shapes, the surface, seen from within, is concave in all directions. Naturally, the shape may be different around the central portion, where the central portion, for example, may comprise protruding elements extending into the convex elements in order to e.g. attach the convex elements to the central portion. However, for other parts of the convex elements, and for convex elements which at these longitudinal positions are not attached to the central portion, the preferred cross section is one which seen from within the cross section is concave in all directions.

In one embodiment, the convex elements comprise therein an enclosed space. In this manner, the walls of the convex element may be made of a more rigid material, where the wall thickness will then determine the hardness of the convex element. Also, providing an enclosed space may ensure that the convex element is not open. Open convex elements may collect ear wax during operation in, introduction into or removal from the ear canal.

In one embodiment, the convex elements are convex when viewed along the longitudinal axis from both directions. This provides the same advantages in relation to not collecting ear wax.

In one embodiment, the central portion has a first length along the longitudinal axis and a predetermined opening at an end thereof, the convex elements being positioned at least 10%, such as at least 15%, such as at least 20%, such as at least 25% of the first length from the end (such as when projected on to the longitudinal axis). In this manner, any sound output of the opening may not be influenced by the presence of the convex elements.

In addition, this may facilitate providing the opening closer to the ear drum than any suitable position of contact between the ear canal and the ear bud.

Further, as the ear wax moves along the surface of the ear canal and thus also of the ear bud, the larger distance to the opening may extend the operational lifetime of the ear bud, as it may take a longer time for ear wax to reach and clog the opening.

In one embodiment, the convex elements are drop-shaped with a blunt end and a more pointed end, the more pointed ends being directed toward the first end of the central portion. When the more pointed end of the convex elements are pointed in the same direction, introduction may be performed in the same direction so that the overall shape or cross sectional area of the ear bud is smaller in the first portion introduced into the ear canal but expands along the longitudinal axis. The shape of the ear bud thus gently expands the ear canal as it moves into the ear canal.

Another advantage of the drop shape is that the more pointed end (which may still be rounded) may be provided close to the central portion and thus not get into contact with the ear canal, whereas the blunt ends of the convex elements will contact the ear canal. These ends however have a rather large curvature radius and thus have a large contact area.

In one embodiment, the convex elements form part of an outer element comprising a sleeve inside which the central portion is provided. Thus, assembly and attachment of the convex elements is rather easy, as the central portion is merely provided therein and fastened, if desired, in any suitable manner, such as welding or gluing.

Then, the central portion may be made of one material and the outer element of another material, which has the desired softness. The central portion may be made of a material sufficiently hard to be able to be attached, such as detachably attached, to a receiver, s spout/nozzle or a tube. Then, the central portion may comprise ridges or one or more threads in the channel if desired.

In one embodiment, the central portion has a first length along the longitudinal direction and each convex element is attached to the central portion along a distance exceeding 10% of the first length, such as at a distance exceeding 20%, 30%, 40%, 50%, 60% or 70% of the first length. Attachment over a distance firstly may aid in defining the extent and/or direction of the convex elements, which may be elongate and extend along the longitudinal direction or at least partly along the longitudinal direction. In a number of cross sections perpendicular to the longitudinal direction, the engagement between the central portion and a convex element may be at at least substantially the same angular position. This may be the situation for all convex elements. The convex elements may be attached to the central portions along their entire lengths or an entire interval of positions along the longitudinal direction at which both the central portion and the convex elements exist.

Preferably, all convex element(s) take(s) up a total angle, seen from the longitudinal axis and when projected on to a plane perpendicular to the longitudinal axis, of no more than 350 degrees, such as no more than 340 degrees, such as no more than 330 degrees, such as no more than 320 degrees. When the convex elements take up a smaller, total or combined angle than 360 degrees, the convex elements are able to deform in a direction in the plane to accommodate the shape of an ear canal.

In general, the concave elements may be solid, such as comprising a foam, such as an open cell foam, polymer or other deformable material, or may be hollow. Hollow concave elements may have an opening toward the second end so as to, when viewed along the longitudinal direction from the second end to the first end, be concave.

Naturally, the central portion may be longer than, have the same length as or be shorter than the concave elements along the longitudinal axis.

In some embodiments, an opening or channel is provided in at least one convex element allowing air or sound from passing through the convex element from a position at the first end to a position at the second end, such as generally in a direction parallel to the longitudinal axis. An opening or channel of this type may be used for allowing air or sound to pass through the dome, such as from outside of the ear to the ear drum.

In some embodiments, an opening is provided in the central portion at a position where no convex element is provided, such as between to adjacent convex elements, to allow sound or gas, such as air and/or vapour, to enter the channel of the central portion from outside of the dome. An opening may then be provided from the channel to the outside of the ear bud/dome, such as in a position between two neighbouring convex elements and/or such as to a position configured to be directed toward an ear drum of a person, so that the air/gas/sound may enter from outside of the ear to between the dome and eardrum.

In addition or alternatively, a channel or opening may be provided inside a convex element and through an opening from inside the convex element into the channel of the central element. This channel or opening may also or instead be used for allowing sound or gas to enter the central element from outside of the convex element. Again, the other opening may be provided to allow gas/sound to pass from outside of the dome to the ear drum.

Naturally, the channel may be formed alternatively or additionally in material forming the central portion and/or convex elements.

Inside the central element, a microphone may be arranged to receive sound from the opening between the convex elements or the channel through the convex element. This sound may be used in the deriving of an acoustic signal to be output from a sound emitter either also provided in the central element or provided outside of the central element but feeding the sound to the central element.

Additionally or alternatively, a valve may be provided for blocking gas flow or sound through the opening or channel. Then, the acoustical properties of the opening or channel may be controlled.

Naturally, a wax filter may be provided in the opening or channel if desired. This wax filter may be a separate element introduced into the dome, or an element made of the same material, such as moulded from the same material and at the same time. A wax filter may be embodied as a grating, a porous material/structure or the like.

A second aspect of the invention relates to an ear bud or dome comprising, in a rest position thereof:

- a central portion comprising therein a channel defining a central, longitudinal axis, the central portion having a first end and a second end,
- a plurality of soft cushioning elements extending away from the central portion.

Naturally, all considerations and features/embodiments of the first aspect of the invention may be equally valid in relation to the second aspect.

Again, any number of cushioning elements may be used, such as 2, 3, 4, 5, 6, 7, 8, 9, 10 or more.

Again, the cushioning elements are soft, such as when having a hardness of 40 Shore A or less, and preferably have the function, position and shapes of the convex elements described above.

In one embodiment, the central portion has, when projected on to a plane perpendicular to the longitudinal axis, a circumscribed circle with a first radius, and the cushioning elements extend a distance equal to at least the first radius away from the central portion in a direction perpendicular to the longitudinal axis. Preferably, the distance and the softness/hardness will define the resiliency and deformability of the cushioning elements.

Thus, the cushioning elements may extend a distance equal to 1.5 or more, such as 1.6 or more, 1.7 or more, 2 or more, times the first radius, away from the central portion.

In one embodiment, the cushioning elements, such as an outer portion thereof, which may be determined as described above, take up a total angle, seen from the longitudinal axis and when projected on to a plane perpendicular to the longitudinal axis, of at least 80 degrees.

A third aspect relates to an assembly of an ear bud or cone according to any of the other aspects of the invention and a receiver or an end of a tube provided in the channel. This receiver and/or tube may be fixed to the channel, such as within the channel. This fixing may be detachable or permanent.

A fourth aspect of the invention relates to an ear bud or dome comprising:

- a central portion with a channel having a first and a second opening, the channel defining a longitudinal axis,
- a dome portion having an outer surface extending from the central portion, at a first longitudinal position along the longitudinal axis, and away from the longitudinal axis and away from the first opening of the channel,
- a first wax preventing element in the channel and at a second longitudinal position and
- a second wax preventing element in the channel and at a third longitudinal position being different from the second longitudinal position.

Naturally, this aspect of the invention may be combined with any of the other aspects and embodiments.

This ear bud may be of the type seen in all "in the ear canal" hearing aids today. However, two wax protection elements are provided, as it has been found that this may prolong the operational life of a receiver attached to the bud or the period of time where a sound tube remains operational.

The first longitudinal position may be any position along the central portion. This is not of relevance. Also, the dome portion may be any prior art dome, closed or open.

In one embodiment, the first wax preventing element is detachably attached to the central portion. This first wax preventing element may form part of an element forming also an output of the channel if desired.

Then, the second longitudinal position thus preferably is close to an end of the channel, such as at a distance no more than 20%, such as no more than 10%, such as no more than 5% of a total length of the channel, away from the end of the channel.

The second wax preventing element may be positioned at any position, such as closer to the centre of the channel, such as 30-50% of the total length away from an opening of the channel.

In general, a wax filter may be embodied in a number of manners. Also, two wax filters may be provided as a single element having two co-extending elements each capable of filtering or collecting wax.

In one embodiment, the wax filter has an outer periphery and two portions each extending from the outer periphery and each spanning a space inside the outer periphery. In one embodiment, the outer periphery defines a plane where the two portions extend on either side of this plane. In one embodiment, the two portions may be curved and form half shells engaging at the outer periphery.

Then, the two portions each is configured to filter wax, such as if embodied as grids and/or made of a porous material.

Each portion or both portions may be detachably attached to a portion forming the outer periphery.

Then, the filter may be attached in a channel by firstly assembling it and then providing it in the channel, where the outer periphery then engages an inner wall of the channel.

A fifth aspect of the invention relates to an ear bud or dome comprising, in a rest position thereof:

- a central portion comprising therein a channel defining a central, longitudinal axis, the central portion having a first end and a second end and a first length,
- a plurality of drop-shaped elements each extending away from the central portion and being attached to the central portion along at least a second distance being no less than 30% of the first length.

Naturally, all of the above aspects and embodiments may be combined with this aspect of the invention.

In one embodiment, the drop-shaped elements have a blunt end and a pointed end where the blunt ends of the drop-shaped elements are directed in the same direction, such as toward the first end or away from the second end. The pointed ends may also or alternatively be pointing in the same direction, such as toward the first end or the second end.

The drop-shaped elements may be attached to the central portion along any second distance, such as no less than 40%, such as no less than 50%, such as no less than 60%, such as no less than 70% of the first length.

Another aspect of the invention relates to an ear dome or ear bud according to any of the preceding aspects and embodiments which has convex elements and a central portion dimensioned so that when introduced into a channel with a predetermined diameter, the convex elements are deformed to a degree where neighbouring convex elements touch each other.

Even though the channel preferably has a circular cross section (with the predetermined diameter), the ear bud/dome would also be useful in e.g. an oval channel with the same cross sectional area.

In one embodiment, the combined cross sectional area of the central portion and the convex elements, at longitudinal position at which this cross sectional area is the largest, does not exceed a cross sectional area of the channel, at least when the convex elements are solid or have air impenetrable walls with a porous material or a gas inside.

When the convex elements are hollow (such as if concave seen from below), the combined cross sectional area of the central portion and the walls of the concave elements, at the longitudinal position where this combined cross sectional area is the largest, preferably do not exceed the cross sectional area of the channel. In this situation, the combined cross sectional area, at the longitudinal position, of the central portion and of the convex elements (the outer contour and not just the walls) may exceed that of the channel, as the convex elements may, during deformation, obtain a reduced cross sectional area without problems.

Thus, this combined cross sectional area may be 100-150% of the cross sectional area of the channel, such as 100-140%, such as 105-130%, such as 105-120%.

Preferably, the combined cross sectional is no less than 80%, such as no less than 90%, such as no less than 95% of the cross sectional area of the channel.

A final aspect of the invention relates to an ear bud or dome which may be in accordance with the above aspects and embodiments but which may also have a known structure, such as the umbrella-like structures, where the ear bud/dome has a central portion and outer portion(s) configured to engage an ear canal and which are resilient at least to some degree, where the central portion has therein an inner space or a channel and where the ear bud/dome comprises an opening from outside of the ear bud/dome into the channel. The channel may have an opening to the surroundings at one end, such as to output sound from a receiver provided in the channel. Then, the opening may be an opening into the channel from a side thereof. In the ear bud/dome, an opening may exist around the receiver, so that gas or sound may travel into the opening, around the receiver and out of the end opening. In this manner, pressure equalization and/or dehumidification may take place. Also, or alternatively, sound may be allowed to enter the space between the dome and the eardrum from outside of the ear, which may be desired in some embodiments.

Preferably, the outer portion(s) is/are connected to the central portion at one longitudinal position on a longitudinal axis, such as a symmetry axis, of the central portion. Then, the end opening may be on one side of this longitudinal position and the side opening may be at an opposite side of the longitudinal opening so that even if the outer portions block sound/gas transport past the longitudinal position outside of the central portion, such transport is possible through the central portion.

Naturally, a wax protection filter may be provided in this side opening to prevent wax from entering the channel. this wax protection filter may be according to the filters described above and below.

BRIEF DESCRIPTION OF THE DRAWINGS

In the following, preferred embodiments of the invention are described with reference to the drawing, wherein.

DETAILED DESCRIPTION OF THE INVENTION

Figure 1:
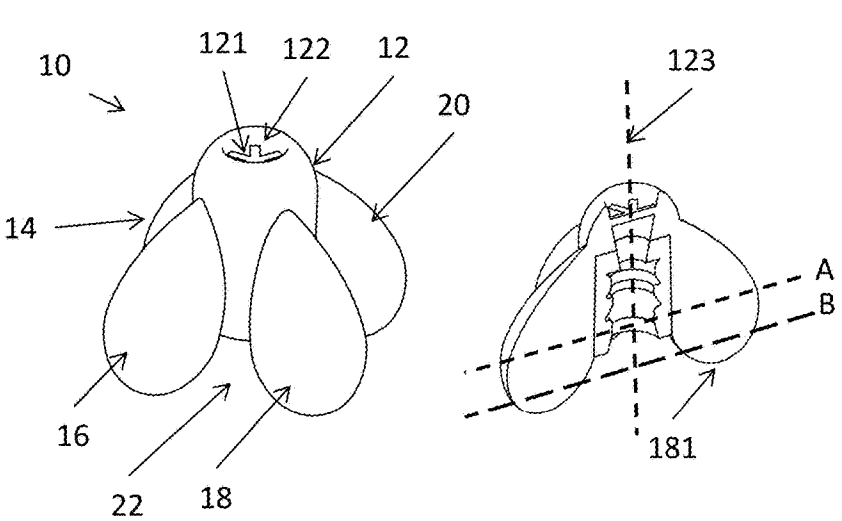
FIG. 1 illustrates a first embodiment of an ear bud according to the invention.

In FIG. 1, an ear bud or dome 10 is illustrated for use in fixing a receiver or sound tube in the ear canal of a person.

Clearly, what is desired is an ear bud which is comfortable to wear, introduce and remove, while fulfilling the task of maintaining the receiver or sound tube securely in place during operation. Introduction/removal, however, requires that the ear bud is able to pass bending, winding and/or narrow portions of the ear canal while it should be able to remain in a desired position for extended periods of time without causing pain to the user.

The ear bud has a central portion 12 with an opening 122 wherein a wax filter (grating) 121 is provided. From the central portion 12, four protruding, convex elements 14, 16, 18 and 20 extend. The convex elements are equally spaced around the circumference of the central portion. A space 22 is provided between each pair of convex elements, so that the convex elements may be deformed by compressing these toward the centre of the central portion 12, such as toward a central, longitudinal axis 123 thereof, where this deforming may result in an expansion of the convex element in a direction perpendicular to the direction of the deforming force.

Thus, when this earbud is forced into and through an ear canal, the convex elements are able to deform and thus adapt to the shape and dimensions of the ear canal. The spaces 22 will allow the convex elements to deform instead of vastly increasing the pressure exerted to the ear canal walls. Also, the convex elements should be so soft that when the ear canal comprises a convex part exerting a compressive force to a portion of a convex element, the outer shape of the convex element may adapt to this convex part so that no local force exerted to the ear canal becomes excessive.

Preferably, the convex elements have an overall hardness of no more than 40, 30 or even 20 Shore A. A hardness—or resilience—of this order may be obtained providing solid convex elements of a sufficiently soft material or providing a thinner wall of a harder material, where the convex element may be hollow or filled with a softer material, such as foam. A hollow convex element may comprise air or gas, such as at a pressure of up to 5 kPa, such as in the interval of 2-4 kPa.

Suitable materials for the convex elements and central portion are, for example, LSR (Liquid Silicone Rubber) or TPE (Thermoplastic Elastomer).

It is seen that the outer portions of the convex portions are curved and have no sharp edges or portions which may damage the ear canal. The outermost portions may be all portions further away from the central axis 123 than 30%, 40%, 50%, 60%, 70%, 80% or even 90% of a radius of a circumscribed circle of the ear bud when projected on to a plane perpendicular to the longitudinal axis 123. These outermost portions, at least, should have the above low hardness and, preferably also, have a curvature of at least 10%, such as at least 20%, such as at least 30%, such as at least 50%, of the radius of the circumscribed circle in order to not have too sharp elements pinching or damaging the ear canal.

Seen from the side and from the top, the convex elements preferably have a smooth surface in order to allow a gentle introduction in the ear canal. Thus, preferably in all cross sections from the top portion of the convex elements to the longitudinal position where the convex elements extend the farthest from the longitudinal axis, the outer periphery of the convex elements preferably define a smooth curve, such as a curve with no curvature with a radius lower than 10%, such as no lower than 20%, such as no lower than 30%, such as no lower than 40%, such as no lower than 50% of a radius of a smallest circumscribing circle in that cross section.

It is also seen that the convex portions are convex when seen along the longitudinal axis 123 from both directions. In the right illustration illustrating a cross-section of the ear bud 10, it is seen that the convex element 18 has a lower surface 181 being convex. This has the advantage that both introduction into and removal from the ear canal is performed without damaging the ear canal. In addition, the convex portions prevent the collecting of ear wax and other contaminants when introducing the ear bud into the ear canal or when removing it again.

In the right illustration, two planes, A and B, both perpendicular to the elongate axis 123, are indicated with hatched lines. In the plane A, the cross section of the ear bud 10 comprises the central portion 12 whereas, in plane B, it does not.

Figure 2:
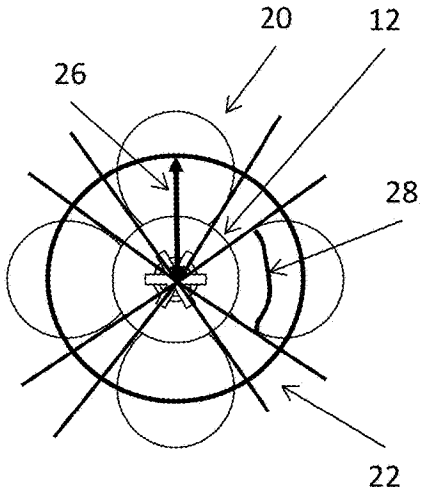
FIG. 2 illustrates a cross section of a second embodiment.

In FIG. 2, a cross section is illustrated of the embodiment of FIG. 1 in the plane A. It is seen that the central portion 12 is there as well as the convex elements, including the convex element 20.

When the ear bud 10 is forced through the ear canal, the outer portions thereof will contact the ear canal and be elastically deformed. Thus, it is especially required that the outer portions are deformable. Therefore, the softness desired is especially of such parts. In FIG. 2, a circle with a radius 26 is illustrated, and the parts outside of the circle are the outermost parts.

In FIG. 2, an angle 28 is illustrated which is the angle the outer portions of a single of the convex elements takes up seen from the longitudinal axis 123. This total angle for the outer portions of all convex elements preferably is rather large, such as larger than 80 degrees, such as larger than 90, 100, 120, 140, 160, or 180 degrees, as this is a measure for the surface area which potentially may be in contact with the ear canal. The larger the contact area, the lower a force is exerted to the ear canal per area (square mm), when the convex elements are as soft as desired.

It is seen that the convex elements, in the cross section, are concave when viewed from any position within the convex elements—at least when viewed in any direction not toward the central portion.

Thus, the convex elements have the shape of a cushion/balloon/drop (made of a soft material) which thereby is deformable to accommodate any shape of the ear canal.

It is noted that in the plane B, the cross section would comprise only the convex elements and not the central portion. However, the overall shape of each convex element would be concave when viewed from any position inside each cross section. Another way of describing the cross section of each convex element in the plane B is that the convex hull of each cross section is identical to the cross section itself.

Naturally, it may be desired to have the central portion 12 be made of a harder material than the convex elements, such as with a Shore A of 20-100, such as 40-60, as this may facilitate a better fixing of a receiver and/or tube thereto. Naturally, this fixing may be a gluing, but a clicking action is preferred.

Figure 3:
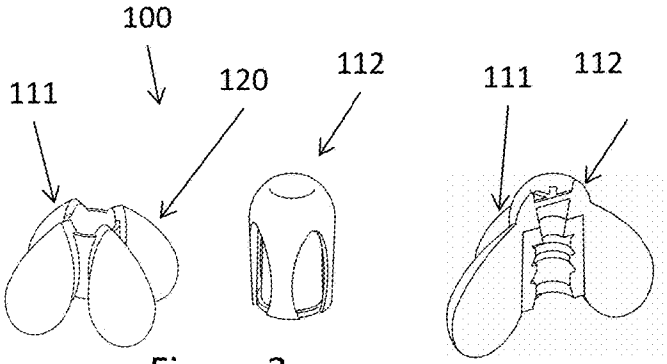
FIG. 3 illustrates another embodiment made of multiple elements.

In FIG. 3, an ear bud 100 is illustrated provided as two separate portions, a central portion 112 and an outer portion 111 which forms four convex portions, one of which is convex portion 120. The outer portion 111 has a channel in which the central portion 112 may be provided and, for example, fastened by gluing, welding, snap fitting or the like.

To the right in the illustration, a cross section of the assembled ear bud 100 is seen, where the central portion is green and the outer portion red.

In this manner, the properties of the central portion 112 and the outer portion 111 and in particular the convex portions 120 may be tailored to obtain the desired product.

It is noted that, in general, the convex elements may be made completely of the same material, or multiple materials may be used where a softer material is used in the outer parts and a harder material used in more central portions.

In a preferred embodiment, referring again to FIG. 1, the opening 122 preferably is positioned further along the longitudinal axis 123 than any portions of the convex elements. A reason for this is that it is desired that the sound output of the opening 122 is not affected by the presence of the convex elements.

Also, as ear wax has a tendency of moving along the surface of the ear canal and thus also of the ear bud 10/100, it is desirable that a distance exists from the convex elements contacting the ear canal wall and the opening 122.

In fact, it may be desired that a distance, along the longitudinal axis, from the opening and to any portion of the convex elements, is no less than 10%, such as 15%, such as up to 50% of a total length, along the longitudinal axis, of the central portion or the channel therein.

Figure 4:
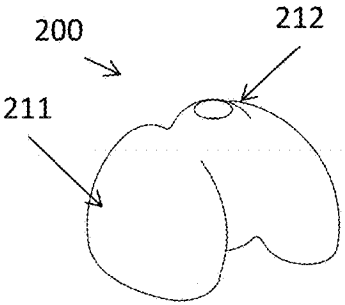
FIG. 4 illustrates another embodiment with two convex elements.

Another embodiment of an ear bud 200 may be seen in FIG. 4, where two convex elements 211 are seen, extending from the central portion 212.

Figure 5:
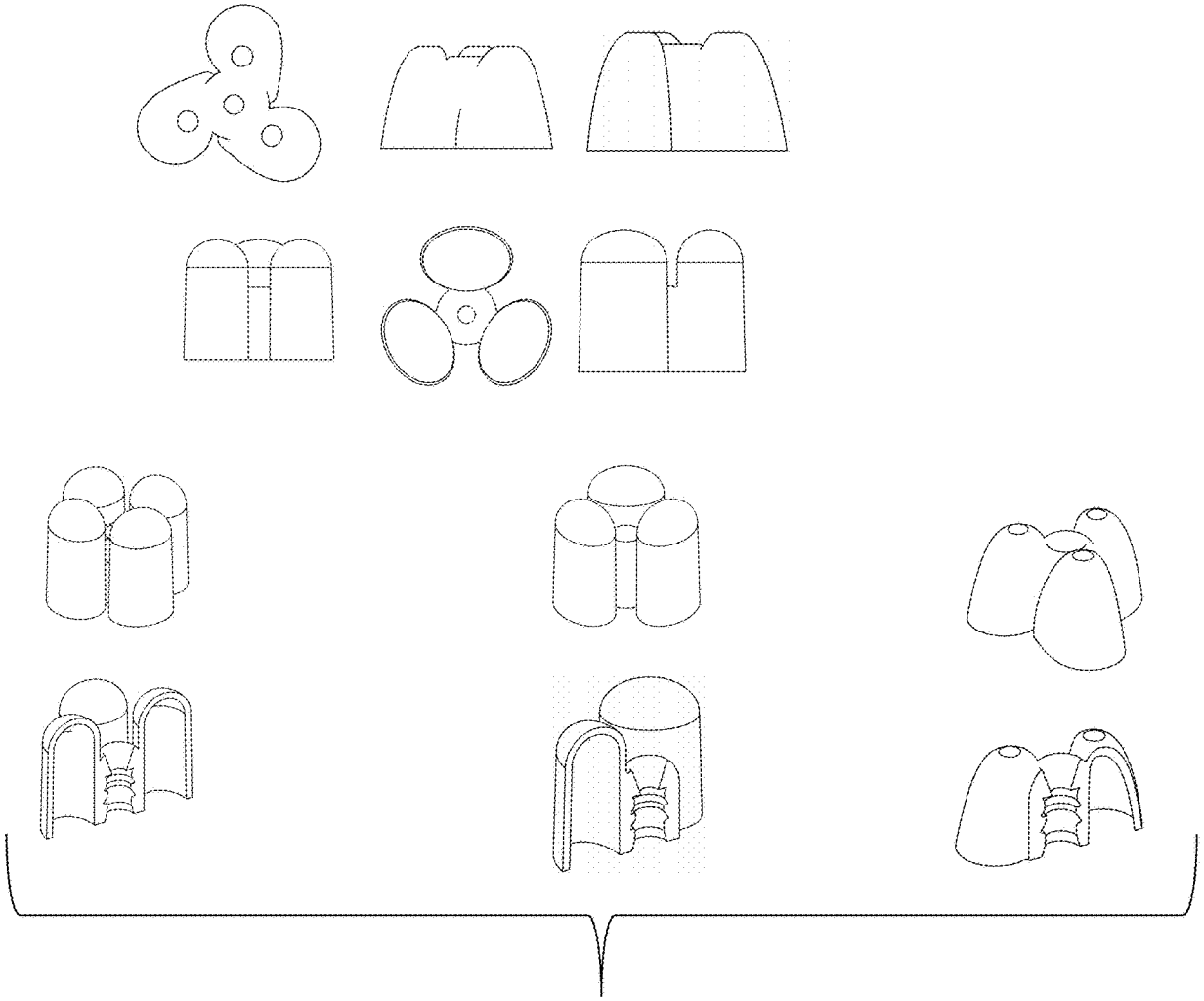
FIG. 5 illustrates further embodiments of the invention and FIG. 6 illustrates an embodiment with bevelled convex elements.

In FIG. 5, additional embodiments of the present ear bud may be seen. Of course, any number of convex elements may be used, and different sizes thereof may be used if desired. The convex elements may or may not be symmetrical around line through the longitudinal axis.

The convex elements may be hollow, such open from the bottom thereof. The elements which are convex when viewed from above and the side thus, when viewed from the bottom, are concave. This has the advantage that deformation may be easier compared to more solid convex elements. Further advantages are seen further below.

A number of other features may be incorporated if desired. The central portion may have therein a thread or ridges for engaging a receiver or sound tube. Alternatively, a receiver or sound tube may be e.g. glued to the central portion.

One or more wax guards may be provided. One is illustrated in FIG. 1 at the opening 122. Instead or in addition, a wax guard may be provided further inside the channel (see FIG. 6). All wax guards may be removable attached so that they may be selected according to a user or be removed, cleaned and re-inserted.

In addition, the uppermost (in the figures) portion of the central portion 12/112/112 may be detachable in order to e.g. provide different shapes of the opening. Thus, the central portion may be formed by two portions fixed to each other by a clicking action or gluing/welding or the like. A number of such front portions may be provided to tailor the central portion to the sound emitting properties required for a particular user.

Figure 6:
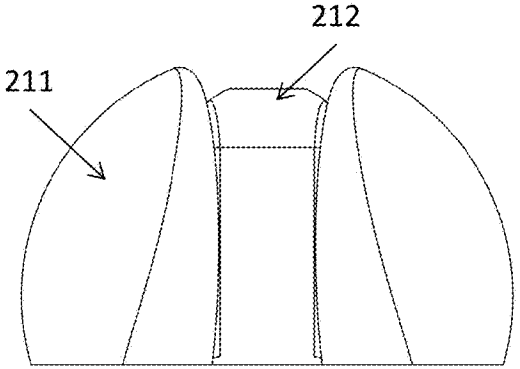

In FIG. 6, an embodiment is seen where the convex elements 211 have a more angled or bevelled and extend to in front of the central portion 212. When the soft convex elements extend to a position in front of the harder central portion, the introduction thereof may be more gentle, as even the tip is soft.

Figure 7:
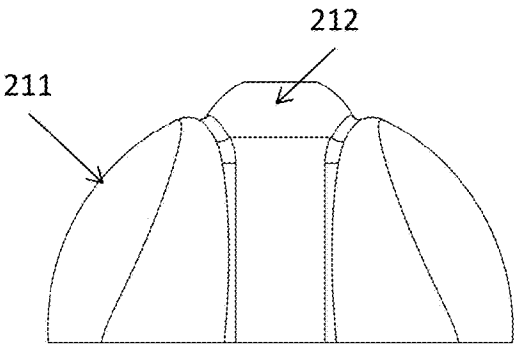
FIG. 7 illustrates another embodiment with bevelled elements.

In FIG. 7, the same angled/bevelled shape is seen for convex elements not extending in front of the central portion.

Figure 8:
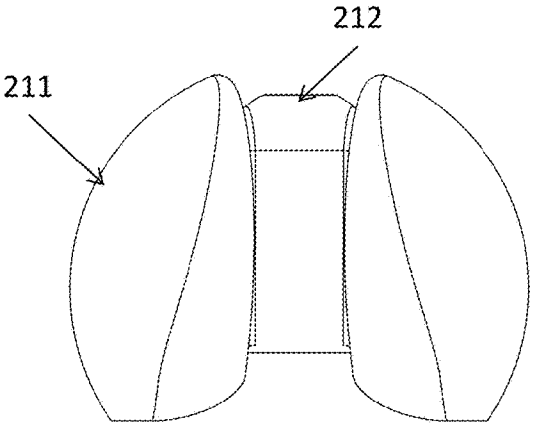
FIG. 8 illustrates an embodiment with convex elements extending further down.

In FIG. 8, the shape seen in FIG. 6 is seen but now for convex elements also extending further to the back (downward direction in the drawing) than the central portion, where the central portion and convex elements in FIGS. 6 and 7 extend to the same longitudinal position.

Figure 9:
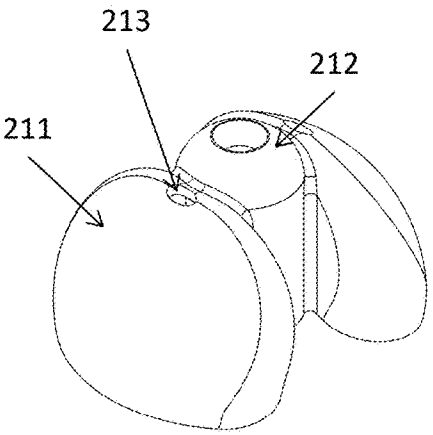
FIG. 9 illustrates an embodiment with openings in the convex elements.

In FIG. 9, an embodiment is seen wherein openings 213 are provided in the convex elements.

As mentioned above, the convex elements 211 are configured to, even when provided in an ear canal (see further below), have openings between them so as to allow sound to pass between neighbouring convex elements and so as to not exert an excessive force to the ear canal. However, the openings 213 provide additional openings for sound to pass through the convex elements 211. In one embodiment, the convex elements 211 are hollow, as seen in FIG. 5, so that sound entering the opening 213 may pass through the ear bud and toward the outside of the ear.

Another use of the openings 213 is to allow air or gas (vapour) to pass from the eardrum to the surroundings to allow pressure equalization or dehumidify the space between the eardrum and the dome.

Additionally, the openings 213 tend to prevent buckling caused by the deformation of the convex elements during deformation. Buckling has a tendency of creating creases and thus a non-uniform force exertion to the ear canal.

Figure 10A:
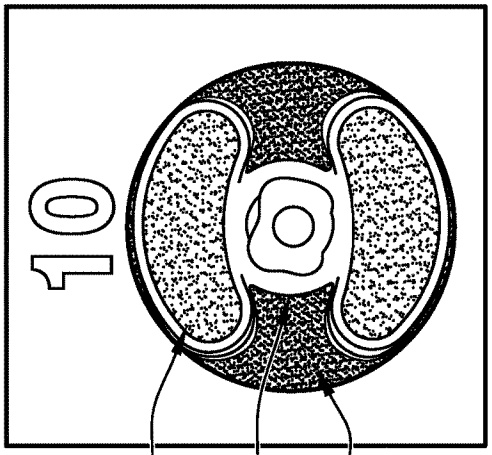
FIGS. 10A-10D illustrate a dome introduced in an ear canal.
Figure 10B:
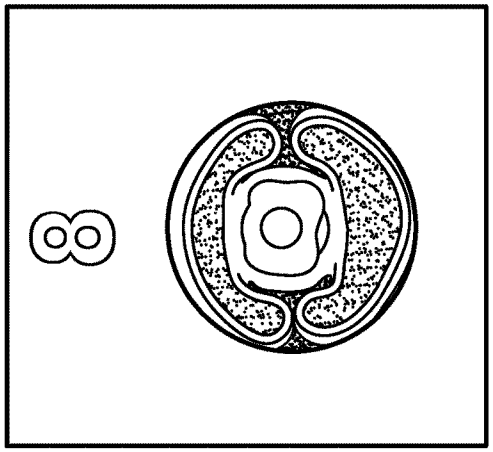
Figure 10C:
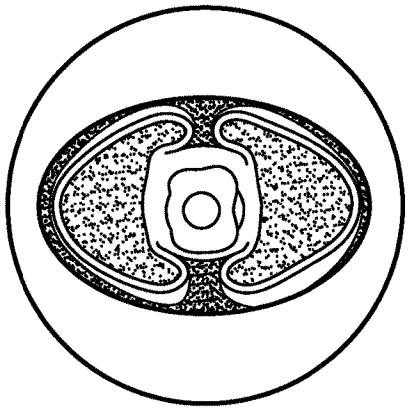
Figure 10D:
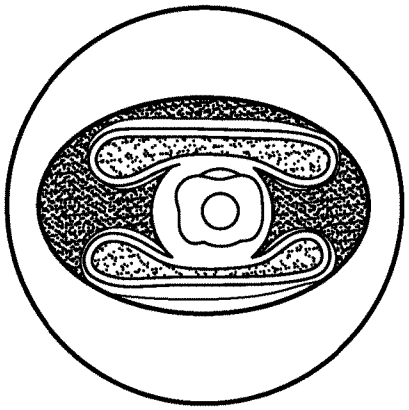

In FIGS. 10A-10D, a dome as that illustrated in FIG. 4 is introduced into different channels with typical dimensions of an ear canal. In FIG. 10A, the channel is circular in cross section with 10 mm diameter. In FIG. 10B, the channel is circular in diameter with 8 mm diameter. In FIGS. 10C and 10D the channel is oval and the ear bud rotated 90° in FIG. 10C compared to FIG. 10D.

It is seen that irrespective of the dimensions and channel shape, the convex elements of the ear dome are dimensioned to not touch each other so that further compression is possible without exerting an excessive force to the ear canal wall. The openings thus provided may also be used by sound to pass the ear dome which may therefore be called "open" as opposed to so-called "closed" domes which prevent sound from passing there through.

Figure 11:
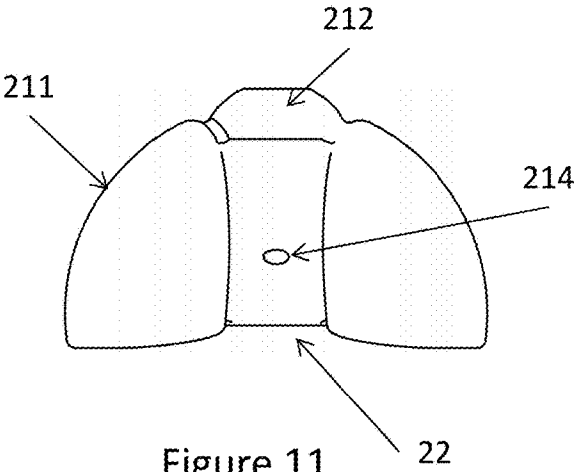
FIG. 11 illustrates an embodiment with an opening into the central portion.

In FIG. 11, an ear dome is illustrated having an opening 214 in the central portion 212 at a position where no convex element is seen, i.e. in the space 22. As mentioned above, this space 22 is not closed even when the ear dome is positioned in an ear canal, so sound/gas form outside of the ear or inside of the ear may pass through this space.

This opening 214 may be used for feeding sound to a microphone positioned in the central element 212. This microphone may then detect sound from outside of the ear or from inside of the ear.

An alternative use of the opening 214 would be as a part of a venting channel or acoustic channel extending from outside of the central element to inside the central element for allowing sound to enter the central element. Then, a valve may be provided in this path, such as close to the opening 214 for blocking the path to prevent venting or sound from entering through the opening 214.

Thus, in addition to any sound passage though the spaces 22, an additional sound passage may be created via the opening(s) 214, where a valve is provided for controlling the additional sound passage. Then, the acoustic properties of the sound transport from one side of the dome to the other side, typically from outside of the ear canal to between the dome and eardrum, may be controlled by the operation of the valve.

Suitable valve types and sound channel dimensions may be seen in Applicant's co-pending applications filed on 16 Oct. 2017 with the titles "A VALVE, A TRANSDUCER COMPRISING A VALVE, A HEARING DEVICE AND A METHOD", "A SOUND CHANNEL WITH A VALVE AND A TRANSDUCER WITH THE SOUND CHANNEL" and "A PERSONAL HEARING DEVICE", the entireties of which are hereby incorporated by reference.

Naturally, this opening may be covered by a wax filter in order to prolong the operative life of the microphone.

Figure 12:
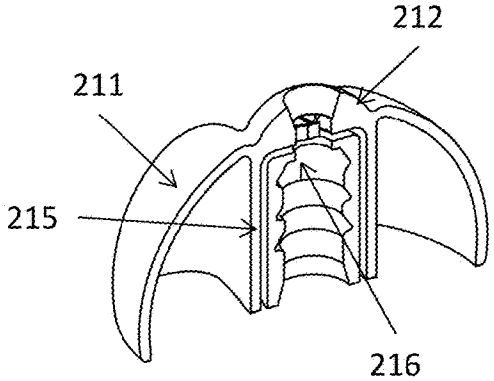
FIG. 12 illustrates an embodiment with a channel, FIG. 13 illustrated another embodiment with a channel.

In FIG. 12, an embodiment is illustrated having a channel 215 which is defined in a wall of the central element 212 or the convex element 211. The channel 215 extends from inside the convex element and opens into the back (lower in the illustration) end of the convex element in order to allow sound or gas to enter and exit the channel from this side of the convex element. The channel 215 opens into the central opening via an opening 216.

Figure 14:
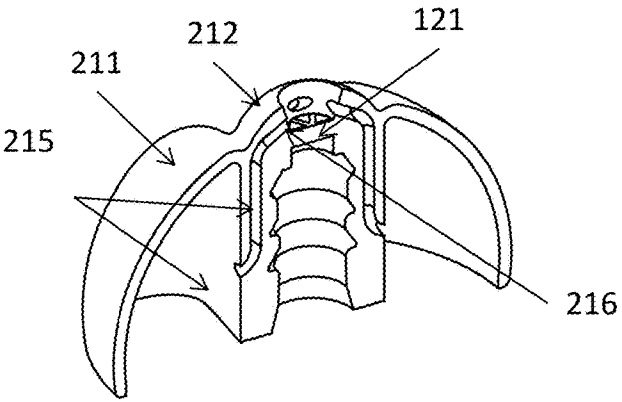
FIG. 14 illustrates a third embodiment with a channel.
Figure 13:
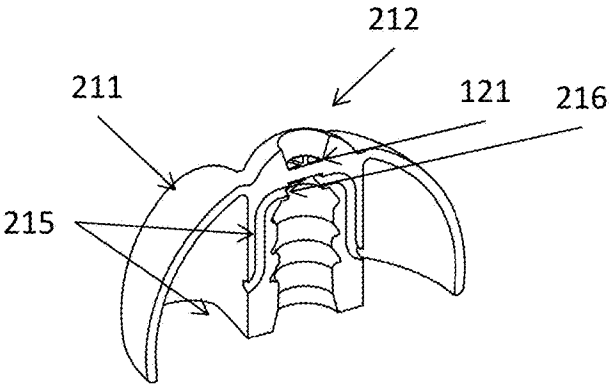

In FIGS. 13 and 14, an alternative is illustrated wherein the convex element is hollow or concave (when seen from the back side) element as seen in FIG. 5 so that the channel 215 may extend therein. A portion of the channel 215 extends within the wall, but the opening 216 may alternatively extend directly from the central opening to the opening in the convex element.

An opening 216 from inside the central element 212 into the channel 215 is formed so as to allow sound or gas entering the channel 215 to enter the central element 212 via the opening 216.

In FIG. 13, the opening 216 is below a wax filter 121 and in FIG. 14, the opening is above the wax filter 121.

Figure 15:
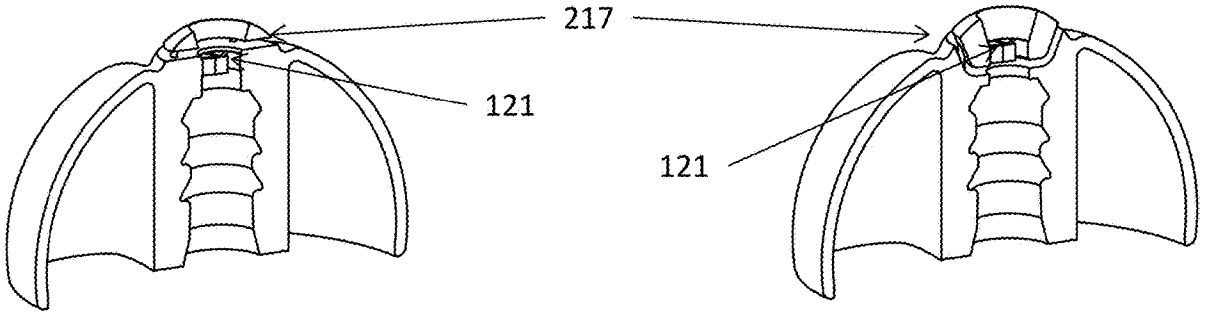
FIG. 15 illustrates embodiments with further tip openings.

In FIG. 15, two embodiments are seen where an additional channel 217 is provided at the tip of the central portion for increasing the overall opening from above (toward the eardrum) the dome to the channel therein. This is due to the danger of wax blocking the main opening, which would otherwise render the dome useless.

The channel 217 may be provided from the outside to a position above (left illustration) a wax filter or below (right illustration) the wax filter (if present at all).

Alternatively, the channel 215 may extend to an opening in the top side of the bud so as to guide sound output from a receiver through the top opening back to a microphone to generate a feedback of that sound. This may be used for controlling the operation of the receiver.

Figure 16:
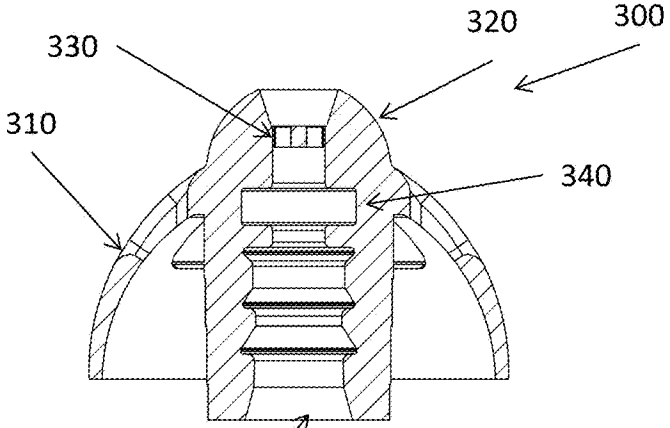

In FIG. 16, a more generic type of ear bud or cone is seen having a central portion 320 with a central channel 325 and a cone or other resilient outwardly extending structure 310 for engaging the ear canal walls during operation. As usual, the channel 325 preferably has elements, such as ridges or a thread, for fastening therein a receiver and/or a sound tube.

In the upper portion of the channel 325, a first wax protection element 330, such as a grating, is provided for preventing wax from reaching especially the receiver/tube fastened inside the channel 325. This first element 330 may be detachably attached, such as by a snap fit action, in the element 320.

Further inside the channel 325, another wax protection element 340 is provided, as it has been found that the first element 330 may not, over time, be able to prevent wax from entering the channel 325. Due to its position, the second wax protection element 340 preferably is permanently fixed inside the channel 325. Embodiments may, however, be arrived at where the second element 340 is detachably attached in the element 320, such as if the outer portion, from the upper tip and to the second element 340, is detachable from the remainder of the central portion 320.

The wax filters may be provided e.g. as flat discs with openings or gratings.

Figure 17:
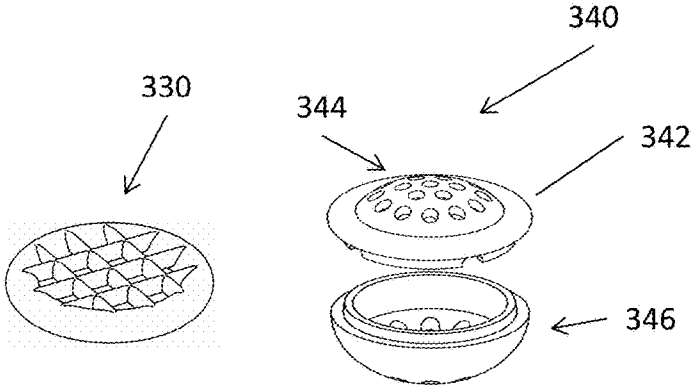
FIG. 16 illustrates an ear bud or cone with two wax protection filters and FIG. 17 illustrates different types of wax protection filters.

In FIG. 17, two types of filters are illustrated. To the left, a plate-shaped grid 330 is illustrated which may be provided in the channel, such as in a ridge thereof, and which may easily be removed, cleaned and replaced.

In the right illustration, a particular type of filter is illustrated which in a single element forms two filters. The filter 340 has an outer portion 342 from which two filters 344 and 346 extend each forming half-shells spanning the space of the outer portion. The filter may be assembled so that the outer portion may be fixed in a channel where the two half-shells then individually act as a filter. The filter 340 may be removed, disassembled, cleaned and re-assembled and re-introduced in the channel.

Naturally, the outer portions 310 may be as those described with reference to the above figures. Alternatively, the known cone types may be used. The present type of cone may be blocking or open.

The invention claimed is:

1. An ear bud or dome comprising, in a rest position thereof:

a central portion comprising therein a channel defining a central, longitudinal axis, the central portion having a first end and a second end, a plurality of convex elements extending away from the central portion, a maximum distance being a largest distance, perpendicularly to the longitudinal axis, from the longitudinal axis to any portion of a convex element, where the convex elements are positioned so as to have, in a cross section perpendicular to the longitudinal axis, a space between neighbouring convex elements, and where all first portions of the convex elements positioned at least 30% of the maximum distance from the longitudinal axis are soft and take up a total angle, seen from the longitudinal axis and when projected on to a plane perpendicular to the longitudinal axis, of at least 120 degrees, and wherein all convex elements, when projected onto a plane perpendicular to the longitudinal axis, take up a total angle of no more than 350 degrees.

2. The ear bud or dome according to claim 1, wherein all portions of the convex elements positioned:

at longitudinal positions within a predetermined distance from the first end and at least 90% of the maximum distance from the longitudinal axis have a curvature radius of at least 10% of the maximum distance.

3. The ear bud or dome according to claim 1, wherein each convex element has, at longitudinal positions along the longitudinal axis of the first portions, in a cross section in a plane perpendicular to the longitudinal axis, have a contour which:

when viewed from a position inside the cross section, is concave in all directions or if the convex element engages the central portion in the cross section, the contour, when viewed from a position inside the cross section, is concave in all directions not directed toward the central portion.

4. The ear bud or dome according to claim 1, wherein the convex elements comprise therein an enclosed space.

5. The ear bud or dome according to claim 1, wherein the convex elements are convex when viewed along the longitudinal axis from both directions.

6. The ear bud or dome according to claim 1, wherein the central portion has a first length along the longitudinal axis and a predetermined opening at an end thereof, the convex elements being positioned at least 10% of the first length from the end.

7. The ear bud or dome according to claim 1, wherein the convex elements are drop-shaped with a blunt end and a pointed end, the pointed ends being directed toward the first end of the central portion.

8. The ear bud or dome according to claim 1, wherein the convex elements form part of an outer element comprising a sleeve inside which the central portion is provided.

9. The ear bud or dome according to claim 1, wherein the first portions of the convex elements positioned at least 30% of the maximum distance from the longitudinal axis have a hardness of 40 Shore A or less.

10. The ear bud or dome according to claim 1, wherein the central portion has a first length along the longitudinal and wherein each convex element is attached to the central portion along a distance exceeding 10% of the first length.

11. The ear bud or dome according to claim 1, wherein each convex element takes up a total angle, seen from the longitudinal axis and when projected on to a plane perpendicular to the longitudinal axis, of no more than 350 degrees.

12. The ear bud or cone according to claim 1, wherein the convex elements have air-impenetrable walls with a porous material inside.

13. The ear bud or dome according to claim 1, further comprising:

a first wax preventing element in the channel and at a first longitudinal position and a second wax preventing element in the channel and at a second longitudinal position being different from the first longitudinal position.

14. The ear bud or dome according to claim 1, wherein the first wax preventing element is detachably attached to the central portion.

15. An ear bud or dome according to claim 1 further comprising an opening or channel extending from the channel to an outer opening positioned between two neighbouring convex elements.

16. An assembly of an ear bud or dome according to claim 1 and a receiver or an end of a tube provided in the channel.

* * * * *